US011051659B2

(12) United States Patent
LaRocca

(10) Patent No.: US 11,051,659 B2
(45) Date of Patent: Jul. 6, 2021

(54) CUSTOMIZABLE TOOTHBRUSH CONTAINER

(71) Applicant: James LaRocca, New Smyrna Beach, FL (US)

(72) Inventor: James LaRocca, New Smyrna Beach, FL (US)

( * ) Notice: Subject to any disclaimer, the term of this patent is extended or adjusted under 35 U.S.C. 154(b) by 0 days.

(21) Appl. No.: 16/517,772

(22) Filed: Jul. 22, 2019

(65) Prior Publication Data

US 2021/0022562 A1 Jan. 28, 2021

(51) Int. Cl.

| | |
|---|---|
| ***A47K 1/09*** | (2006.01) |
| ***A46B 17/04*** | (2006.01) |
| ***A46B 17/06*** | (2006.01) |

(52) U.S. Cl.

CPC ..... *A47K 1/09* (2013.01); *A46B 17/04* (2013.01); *A46B 17/065* (2013.01); *B65D 2205/02* (2013.01)

(58) Field of Classification Search

USPC ..... 206/362.1, 362.2, 361

See application file for complete search history.

(56) References Cited

U.S. PATENT DOCUMENTS

| | | | | | |
|---|---|---|---|---|---|
| 1,676,756 | A * | 7/1928 | Weichsel | A47K 1/09 | 206/362.1 |
| 2,538,337 | A * | 1/1951 | Spears | A47K 1/09 | 206/362.2 |
| 3,748,094 | A * | 7/1973 | Scheidell | A61L 2/10 | 312/207 |
| 3,820,251 | A * | 6/1974 | Borque | F26B 9/003 | 34/60 |
| 3,954,407 | A * | 5/1976 | Andary | A61L 2/10 | 250/455.11 |
| 4,740,706 | A * | 4/1988 | Murdock, III | A61L 2/10 | 250/455.11 |
| 4,806,770 | A * | 2/1989 | Hylton | A47K 1/09 | 250/455.11 |
| 4,927,011 | A * | 5/1990 | Wilkinson | A45D 44/18 | 206/217 |
| 5,127,521 | A * | 7/1992 | Bourque | A61L 2/10 | 206/15.2 |
| 5,630,505 | A * | 5/1997 | Garcia | A45D 44/18 | 206/362.1 |
| 6,186,324 | B1 * | 2/2001 | Catterson | A45D 44/18 | 206/15.2 |
| 6,565,819 | B1 * | 5/2003 | Herrera | A46B 17/06 | 422/26 |
| 8,074,814 | B2 * | 12/2011 | Morris | A47K 1/09 | 211/65 |
| 8,522,973 | B2 * | 9/2013 | Joseph | B65D 51/248 | 206/362.2 |
| 8,809,807 | B2 * | 8/2014 | Nelson | A61L 2/10 | 134/18 |
| 2004/0155201 | A1 * | 8/2004 | Russell | A61L 2/10 | 250/455.11 |

(Continued)

*Primary Examiner* — Jacob K Ackun

(74) *Attorney, Agent, or Firm* — The Iwashko Law Firm, PLLC; Lev Ivan Gabriel Iwashko

(57) ABSTRACT

A customizable toothbrush container, including a main body to receive at least a portion of a toothbrush therein, and a UV light disposed on at least a portion of an interior surface of the main body to sterilize the toothbrush in response to an illumination of the UV light.

3 Claims, 3 Drawing Sheets

(56) References Cited

U.S. PATENT DOCUMENTS

| | | | | |
|---|---|---|---|---|
| 2007/0080081 | A1* | 4/2007 | Chang | A61L 9/015<br>206/362 |
| 2009/0189084 | A1* | 7/2009 | Pinsky | A46B 17/06<br>250/455.11 |
| 2009/0200184 | A1* | 8/2009 | Cullen | A47K 1/09<br>206/362.2 |
| 2014/0150189 | A1* | 6/2014 | Shigeno | A61C 17/224<br>15/22.1 |

* cited by examiner

CUSTOMIZABLE TOOTHBRUSH CONTAINER

BACKGROUND

1. Field

The present general inventive concept relates generally to a container, and particularly, to a customizable toothbrush container.

2. Description of the Related Art

A toothbrush is a common device used by people to clean teeth. The toothbrush can come in a variety of shapes, sizes, electric, and non-electric. Unfortunately, electric toothbrushes tend to lack an aesthetic appeal because they are typically oddly shaped.

Additionally, containers for toothbrushes collect dirt and residue from the toothbrush. As such, the containers can cause the toothbrush to become more dirty.

Therefore, there is a need for a customizable toothbrush container that masks unsightly toothbrushes.

SUMMARY

The present general inventive concept provides a customizable toothbrush container.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a customizable toothbrush container, including a main body to receive at least a portion of a toothbrush therein, and a UV light disposed on at least a portion of an interior surface of the main body to sterilize the toothbrush in response to an illumination of the UV light.

The main body may include a bottom portion, and a top portion removably disposed on an end of the bottom portion to cover an interior portion of the bottom portion.

The customizable toothbrush container may further include a motor disposed within at least a portion of the main body to rotate the top portion, such that the UV light illuminates a greater surface area of the toothbrush.

The main body may include a draining aperture disposed on at least a portion of the main body to facilitate evaporation or draining of liquid from the toothbrush away from the main body.

The main body may include at least one venting aperture disposed on at least a portion of the main body to permit air to flow in and out of the main body.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
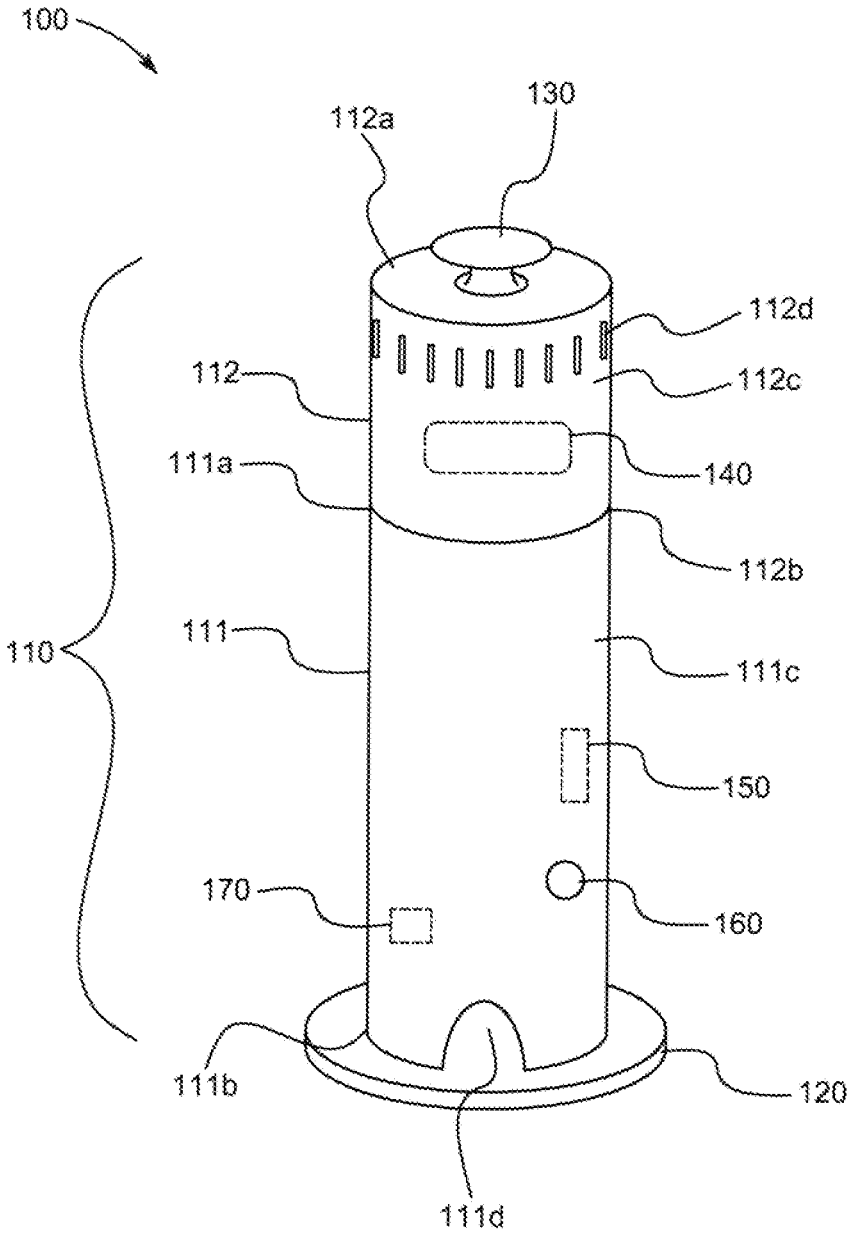
FIG. 1 illustrates a side perspective view of a customizable toothbrush container, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Customizable Toothbrush Container 100
Main Body 110
Bottom Portion 111
First End 111*a*

Second End 111*b*
Bottom Cylindrical Surface 111*c*
Draining Aperture 111*d*
Top Portion 112
First End 112*a*
Second End 112*b*
Top Cylindrical Surface 112*c*
Venting Aperture 112*d*
Base 120
Handle 130
Ultraviolet Light 140
Motor 150
Button 160
Power Source 170

FIG. 1 illustrates a side perspective view of a customizable toothbrush container 100, according to an exemplary embodiment of the present general inventive concept.

The customizable toothbrush container 100 may be constructed from at least one of metal, plastic, wood, glass, and rubber, etc., but is not limited thereto.

The customizable toothbrush container 100 may include a main body 110, a base 120, a handle 130, an ultraviolet (UV) light 140, a motor 150, at least one button 160, and a power source 170, but is not limited thereto.

Referring to FIG. 1, the main body 110 is illustrated to have a substantially cylindrical shape. However, the main body 110 may be a rectangular prism, circular, conical, pentagonal, hexagonal, octagonal, or any other shape known to one of ordinary skill in the art, but is not limited thereto.

The main body 110 may include a bottom portion 111 and a top portion 112, but is not limited thereto.

Referring again to FIG. 1, a length of the bottom portion 111 is illustrated to be greater than a length of the top portion 112. However, the length of the bottom portion 111 may be equivalent to and/or greater than the length of the top portion 112. Additionally, although, the main body 110 is illustrated as having two separate portions, such as the bottom portion 111 and the top portion 112, the main body 110 may be a single, undivided unit.

The bottom portion 111 may include a first end 111*a*, a second end 111*b*, a bottom cylindrical surface 111*c*, and a draining aperture 111*d*, but is not limited thereto.

The top portion 112 may include a first end 112*a*, a second end 112*b*, a top cylindrical surface 112*c*, and at least one venting aperture 112*d*, but is not limited thereto.

The second end 111*b* of the bottom portion 111 may be removably disposed on at least a portion of the base 120. Moreover, a diameter of the base 120 may be greater than a diameter of the main body 110. As such, the base 120 may stabilize the main body 110 in response to the main body 110 being disposed thereupon.

Figure 2:
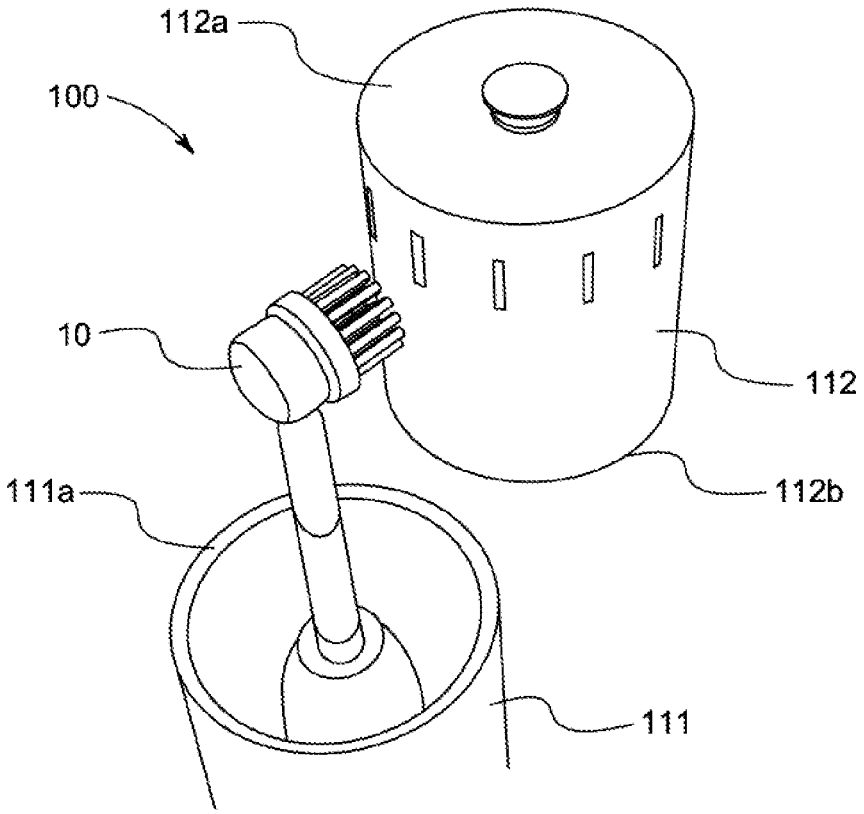
FIG. 2 illustrates a top perspective view of the customizable toothbrush container with a top portion removed, according to an exemplary embodiment of the present general inventive concept.

FIG. 2 illustrates a top perspective view of the customizable toothbrush container 100 with a top portion 112 removed, according to an exemplary embodiment of the present general inventive concept.

Referring to FIGS. 1 and 2, the second end 112*b* of the top portion 112 may be removably disposed on at least a portion of the first end 111*a* of the bottom portion 111. The top portion 112 may be moved away from the bottom portion 111, such that the top portion 112 may be removed to insert and/or access a toothbrush 10 within at least an interior portion of the bottom portion 111, such that the toothbrush 10 may be stored therein and/or extracted therefrom. In other words, the top portion 112 may cover the bottom portion 111, such that a toothbrush 10 may be stored therein. Alternatively, the top portion 112 may be removed to extract the toothbrush 10 from the bottom portion 111.

The bottom cylindrical surface 111*c* may include at least one of a color, a word, a letter, an image, a picture, and/or a textured substrate. Similarly, the top cylindrical surface 112*c* may include at least one of a color, a word, a letter, an image, a picture, and/or a textured substrate. In other words, the main body 110 may have any design based on a preference of a user.

The draining aperture 111*d* may be disposed on at least a portion of the bottom portion 111. The draining aperture 111*d* may facilitate evaporation and/or a liquid falling from the toothbrush 10 on the base 120, such that the liquid may exit out from the interior portion of the bottom portion 111.

Figure 3:
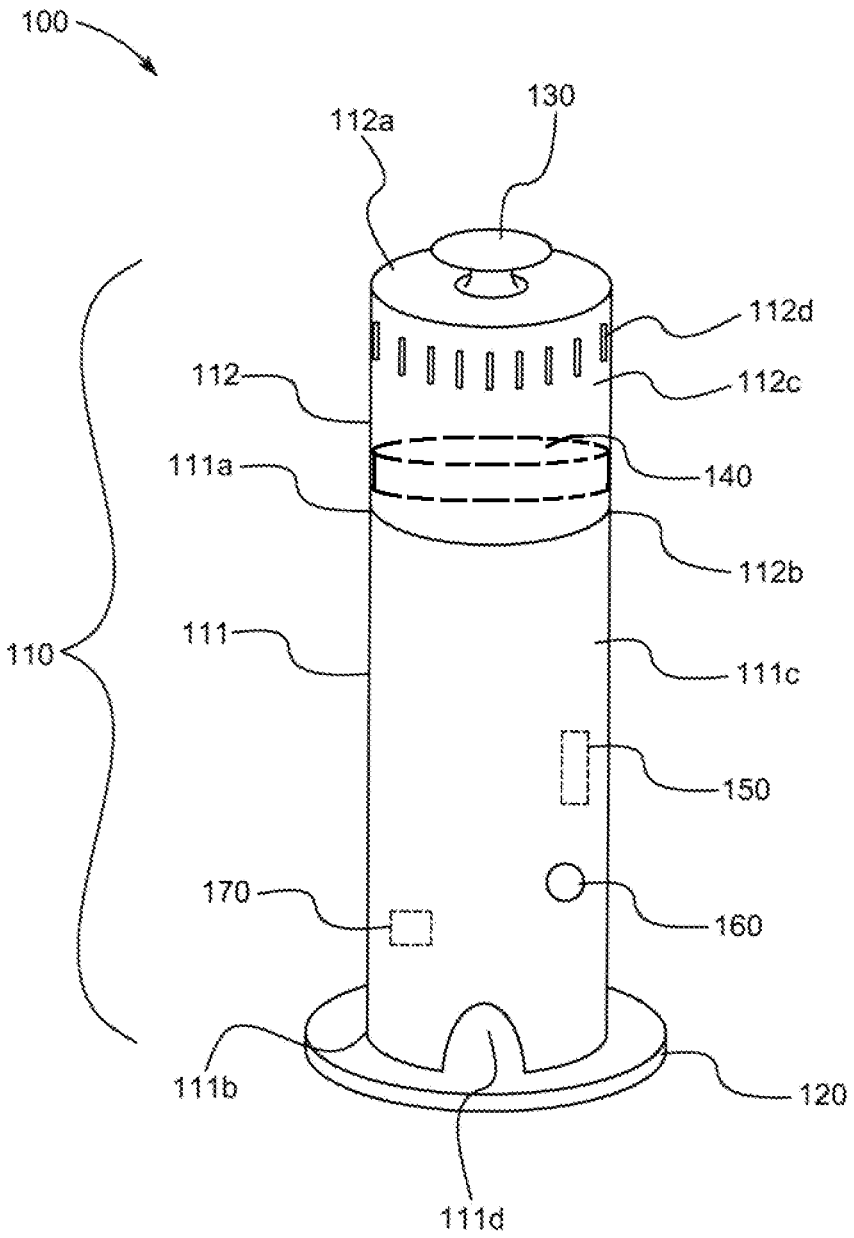
FIG. 3 illustrates a side perspective view of the customizable toothbrush container with a UV light circumferentially disposed on an interior surface of the top portion, according to an exemplary embodiment of the present general inventive concept.

FIG. 3 illustrates a side perspective view of the customizable toothbrush container 100 with a UV light 140 circumferentially disposed on an interior surface of the top portion 112, according to an exemplary embodiment of the present general inventive concept.

The at least one venting aperture 112*d* may be disposed on at least a portion of the top portion 112. The at least one venting aperture 112*d* may facilitate drying of the toothbrush 10, such that air may flow in and/or out of an interior portion of the main body 110.

The handle 130 may be disposed on at least a portion of the first end 112*a* of the top portion 112. The handle 130 may facilitate gripping of the top portion 112 to remove the top portion 112 from the bottom portion 111.

The UV light 140 may be disposed on at least a portion of an interior surface of the top portion 112. Alternatively, the UV light 140 may be circumferentially disposed on at least a portion of the interior surface of the top portion 112. The motor 150 may be disposed on at least a portion of an interior surface of the bottom portion 111. Also, the button 160 may be disposed on at least a portion of the bottom portion 111. The UV light 140 may illuminate in response to the button 160 being depressed a first predetermined number of times and/or for a first predetermined duration of time. As such, the UV light 140 may cleanse and/or sterilize the toothbrush 10 in response to exposure of the toothbrush 10 to the UV light 140, such that the UV light 140 kills bacteria. Additionally, the UV light 140 may terminate after a predetermined time period and/or the button 160 being depressed again.

Alternatively, the motor 150 may rotate in response to the button 160 being depressed a second predetermined number of times and/or for a second predetermined duration of time. As such, the top portion 112 may rotate in response to rotation of the motor 150, such that the UV light 140 may cover a greater surface area of the toothbrush 10. As such, the cleansing and/or sterilization of the toothbrush 10 may be enhanced.

Alternatively, another at least one button 160 may be disposed on at least a portion of the bottom portion 112, such that the user may depress the another at least one button 160 to turn off the UV light 140 and/or the motor 150.

The power source 170 may include a power inlet and/or a battery, such as lithium-ion, nickel cadmium, nickel metal hydride, alkaline, etc., but is not limited thereto.

The power source 170 may be disposed within at least a portion of the bottom portion 111. The power source 170 may provide power to the UV light 140, the motor 150, and/or the button 160, but is not limited thereto.

Therefore, the customizable toothbrush container 100 may improve an aesthetic appeal of an environment by providing a stylish container. Moreover, the customizable toothbrush container 100 is portable. Furthermore, the customizable toothbrush container 100 may clean and/or sterilize the toothbrush 10.

A customizable toothbrush container 100, may include a main body 110 to receive at least a portion of a toothbrush 10 therein, and a UV light 140 disposed on at least a portion of an interior surface of the main body 110 to sterilize the toothbrush 10 in response to an illumination of the UV light 140.

The main body 110 may include a bottom portion 111, and a top portion 112 removably disposed on an end of the bottom portion 111 to cover an interior portion of the bottom portion 111.

The customizable toothbrush container 100 may further include a motor 150 disposed within at least a portion of the main body 110 to rotate the top portion 112, such that the UV light 140 illuminates a greater surface area of the toothbrush 10.

The main body 110 may include a draining aperture 111*d* disposed on at least a portion of the main body 110 to facilitate evaporation or draining of liquid from the toothbrush 10 away from the main body 110.

The main body 110 may include at least one venting aperture 112*d* disposed on at least a portion of the main body 110 to permit air to flow in and out of the main body 110.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A customizable toothbrush container, comprising:

a main body having a cylindrical shape, the main body to receive at least a portion of a toothbrush therein, the main body comprising:

a bottom portion, and a top portion removably disposed on an end of the bottom portion to cover an interior portion of the bottom portion;

a base removably disposed on at least a portion of the bottom portion to receive liquid exiting out from an interior portion of the bottom portion onto a surface of the base oriented toward the main body, such that the base has a diameter greater than a diameter of the main body; and a UV light circumferentially disposed on at least a portion of an interior surface of the top portion to sterilize the toothbrush in response to an illumination of the UV light, such that the interior surface of the top portion has a cylindrical shape, such that the UV light is disposed in a cylindrical shape corresponding to the cylindrical shape of the interior surface of the top portion.

2. The customizable toothbrush container of claim 1, wherein the bottom portion comprises:

a draining aperture disposed on at least a portion of the main body to facilitate evaporation or draining of liquid from the toothbrush away from the main body.

3. The customizable toothbrush container of claim 1, wherein the top portion comprises:

at least one venting aperture disposed on at least a portion of the main body to permit air to flow in and out of the main body.

* * * * *